US011396093B2

(12) United States Patent
Hu

(10) Patent No.: US 11,396,093 B2
(45) Date of Patent: Jul. 26, 2022

(54) PULLER STRUCTURE

(71) Applicant: Chih Kuo Hu, Taichung (TW)

(72) Inventor: Chih Kuo Hu, Taichung (TW)

( * ) Notice: Subject to any disclaimer, the term of this patent is extended or adjusted under 35 U.S.C. 154(b) by 191 days.

(21) Appl. No.: 16/986,227

(22) Filed: Aug. 5, 2020

(65) Prior Publication Data

US 2020/0361069 A1 Nov. 19, 2020

Related U.S. Application Data

(63) Continuation-in-part of application No. 16/165,080, filed on Oct. 19, 2018, now abandoned.

(51) Int. Cl.
*B25B 27/02* (2006.01)
*B25B 27/06* (2006.01)

(52) U.S. Cl.
CPC ..... *B25B 27/023* (2013.01); *B25B 27/062* (2013.01)

(58) Field of Classification Search
CPC ..... B25B 27/023; B25J 15/0028; B23P 11/00; B23P 11/005
USPC ..... 29/244–280
See application file for complete search history.

(56) References Cited

U.S. PATENT DOCUMENTS 481,342 A 8/1892 Bowe
724,818 A * 4/1903 Crane ..... B25B 27/023 29/261
1,207,626 A 12/1916 Ritzdorf
1,388,839 A 8/1921 Allen
1,446,918 A 2/1923 Mielke
1,462,437 A 7/1923 Young
1,470,310 A 10/1923 Winchell
1,475,810 A 11/1923 Frisz
1,631,872 A * 6/1927 Knight ..... B25B 27/023 29/258
1,853,846 A 4/1932 Borchert
4,368,913 A 1/1983 Brockmann et al.
8,517,365 B2 * 8/2013 Velez ..... B25B 5/147 29/259
2013/0152353 A1 * 6/2013 Hu ..... B25B 27/023 29/256

* cited by examiner

*Primary Examiner* — Lee D Wilson
*Assistant Examiner* — Jonathan G Santiago Martinez
(74) *Attorney, Agent, or Firm* — Bradley J. Thorson; DeWitt LLP

(57) ABSTRACT

A puller structure includes a threaded rod, a connecting member, a fixing base, and a driven base. The connecting member is topped with a wing nut. The threaded rod extends downward through the wing nut, the fixing base, and the driven base. The connecting member has a lower portion fixedly connected to the driven base. The fixing base includes a plurality of first fixing arms that extend permanently and obliquely upward. The driven base includes a plurality of second fixing arms that extend outward. The first fixing arms correspond in position respectively to and are shorter than the second fixing arms. Each first or second fixing arm is provided with a groove that extends in the same direction as the fixing arm. A gripping arm is slidably provided in the grooves of each corresponding pair of fixing arms through two pairs of protruding blocks respectively.

3 Claims, 8 Drawing Sheets

PULLER STRUCTURE

This application is being filed as a Continuation-in-Part of U.S. patent application Ser. No. 16/165,080, filed Oct. 19, 2018, currently pending.

BACKGROUND OF THE INVENTION

1. Technical Field

The present invention relates to hand tools and more particularly to the structure of a puller.

2. Description of Related Art

Conventional pullers can be divided into two structural configurations as shown respectively in FIG. 6 and FIG. 7. In either configuration, a plurality of gripping arms are configured to be fastened securely to a workpiece (e.g., a bearing) so that a shaft can be pushed into or pulled out of the workpiece via the spiral action of a threaded rod. Whether a conventional puller can work properly and achieve the intended effect, therefore, depends on whether its gripping arms can be securely fastened to a workpiece. In particular, the larger a workpiece is, the greater the gripping distance formed between the gripping arms must be in order to fasten the gripping arms securely to the workpiece.

Referring to the conventional puller in FIG. 6, each gripping arm 71 is pivotally connected at the top end to a connecting arm 72 of a fixed length and is also connected to a driving arm 73. The driving arms 73 can push the gripping arms 71 outward respectively to form the desired gripping distance. The greatest distance to which the gripping arms 71 can be pushed outward with respect to each other is referred to as the span of the gripping arms 71. When this puller is used on a relatively large workpiece 74 whose size is smaller than the span of the gripping arms 71 but larger than the maximum effective gripping distance between the gripping arms 71 as shown in FIG. 6, the gripping arms 71, which are pivotally connected to the connecting arm 72 at fixed positions and hence do not allow the gripping distance to be further increased, cannot grip the workpiece 74 securely.

Referring to the conventional puller in FIG. 7, each gripping arm 81 is slidably connected at the top end to a connecting arm 82 of a fixed length, and the gripping distance between the gripping arms 81 is equal to the span of the gripping arms 81; that is to say, the distance between the gripping arms 81 dictates the size of a workpiece 83 that can be securely gripped by the gripping arms 81. This type of pullers, however, generally have a relatively long connecting arm 82 that results in bulkiness and consequently inconvenience in storage.

Referring to the conventional puller in FIG. 8, a gripping arm 91 is pivotally connected at a fixed position (pivot joint 94) of the connecting arm 92 and the driving arms 93, therefore the gripping arm 91 is not slidable relative to the connecting arm 92 and the driving arms 93. The connecting arm 92 and the driving arms 93 both are swayable and are extended along the same direction so that the connecting arm 92 and the driving arms 93 cannot remain a permanently extend direction. Eventually, a distance between the two pivot joints 94 cannot be enlarged, hence the force receive points are all distributed on an upper half section of the gripping arm 91.

BRIEF SUMMARY OF THE INVENTION

The primary objective of the present invention is to provide a puller structure that has a greater span and can be opened wider than its prior art counterparts in order to be fixed on relatively large workpieces and have wider application than the conventional pullers.

To achieve the above objective, the present invention provides a puller structure that includes a threaded rod, a connecting member, a fixing base, and a driven base. The fixing base is provided with a threaded hole while the driven base is provided with a through hole. The top end of the connecting member is provided with a wing nut. The threaded rod extends downward through and is threadedly connected with the wing nut and the threaded hole of the fixing base and then extends through the through hole of the driven base. A plurality of extension arms extend downward from the connecting member and are arranged at intervals and fixedly connected to the driven base. A plurality of first fixing arms extend outward from the fixing base. A plurality of second fixing arms extend outward from the driven base. The first fixing arms extend through the gaps between the extension arms respectively and correspond in position to the second fixing arms vertically and respectively. In addition, each first fixing arm and the corresponding second fixing arm are connected with a gripping arm. The first fixing arms extend permanently and obliquely upward from the fixing base while the second fixing arms extend permanently in a curved manner from the driven base, therefore one end of the second fixing arm is connected to the driven base, the other end of the second fixing arm extends permanently downward. Each first fixing arm has a shorter length than the corresponding second fixing arm. Each first fixing arm is provided with a first groove that extends in the same direction as the first fixing arm, and each second fixing arm is provided with a second groove that extends in the same direction as the second fixing arm. Each gripping arm is slidably provided in the corresponding first groove and the corresponding second groove via a first protruding block and a second protruding block respectively.

In one embodiment, the first groove of each first fixing arm is upwardly concavely provided in the bottom side of the first fixing arm, and each first fixing arm has two lateral sides each formed with a first slide slot. Two first protruding blocks are provided respectively on two lateral portions of each gripping arm that face the first slide slots of the corresponding first fixing arm, and extend through the first slide slots of the corresponding first fixing arm respectively. The second groove of each second fixing arm penetrates the second fixing arm vertically, and each second fixing arm has two lateral sides each formed with a second slide slot. Two second protruding blocks are provided respectively on two lateral portions of each gripping arm that face the second slide slots of the corresponding second fixing arm, and extend through the second slide slots of the corresponding second fixing arm respectively.

Preferably, a plurality of first positioning recesses are provided along the bottom edge of each first slide slot in a wavy configuration, and a plurality of second positioning recesses are provided along the bottom edge of each second slide slot in a wavy configuration.

DETAILED DESCRIPTION OF THE INVENTION

Figure 1:
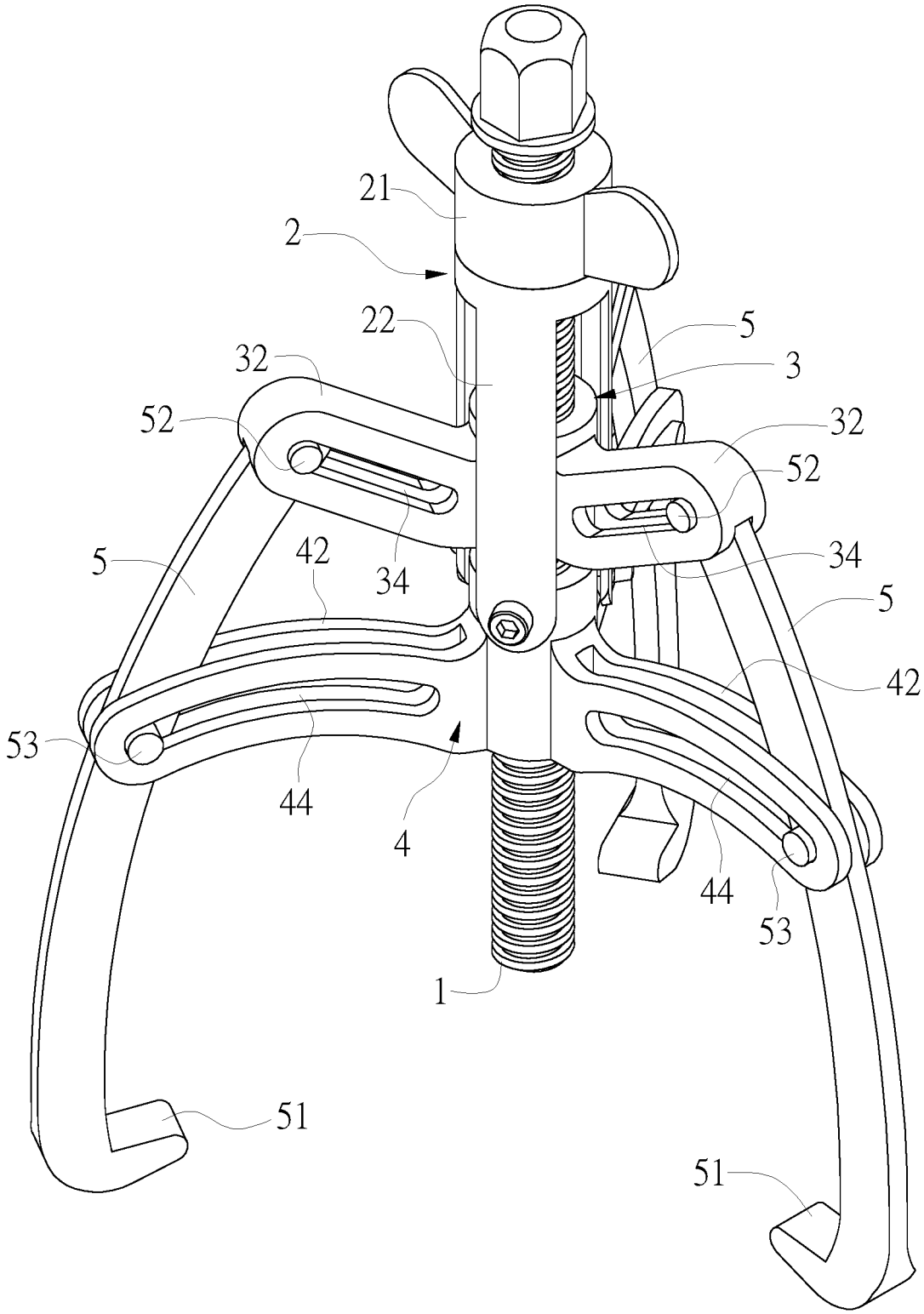
FIG. 1 is a perspective view of the puller structure according to the first embodiment of the present invention.
Figure 2:
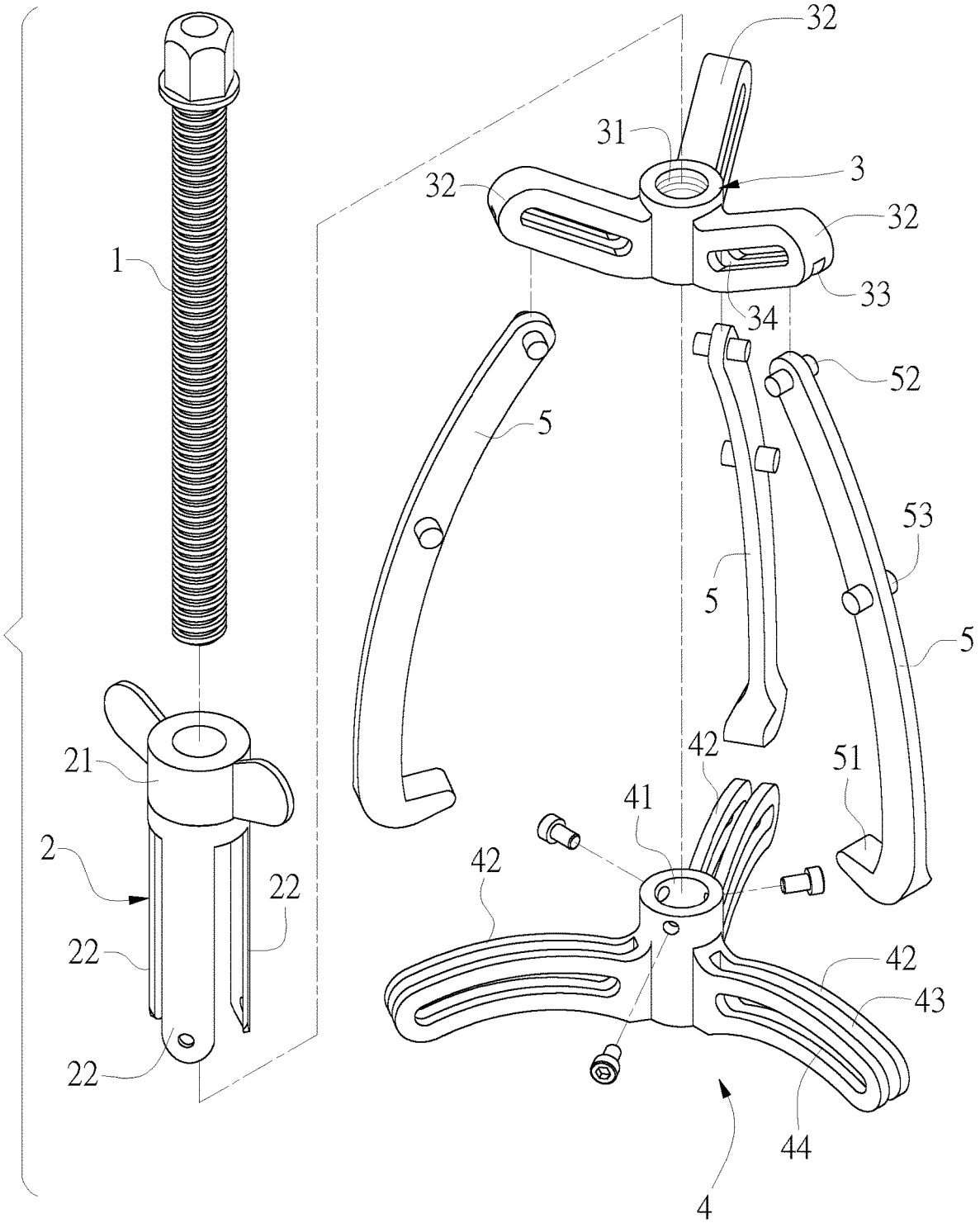
FIG. 2 is an exploded perspective view of the puller structure in FIG. 1.

Referring to FIG. 1 and FIG. 2, the puller structure according to the first embodiment of the present invention includes a threaded rod 1, a connecting member 2, a fixing base 3, and a driven base 4. The connecting member 2 is provided with a wing nut 21 at the top end. The fixing base 3 lies under the connecting member 2, and the driven base 4 lies under the fixing base 3. Three extension arms 22 extend downward from the connecting member 2 and are arranged at intervals and fixedly connected to the driven base 4. The fixing base 3 is provided with a threaded hole 31. The driven base 4 is provided with a through hole 41. The threaded rod 1 is threadedly connected to the wing nut 21, then extends downward to be threadedly connected to the fixing base 3 via the threaded hole 31, and extends further downward through the through hole 41 of the driven base 4.

The fixing base 3 is provided with three first fixing arms 32 that extend outward. The first fixing arms 32 extend through the gaps between the extension arms 22 respectively. More specifically, each first fixing arm 32 extends permanently and obliquely upward from the fixing base 3. The driven base 4 is provided with three second fixing arms 42 that extend outward. More specifically, each second fixing arm 42 extends permanently from the driven base 4 in a curved manner, therefore one end of the second fixing arm 42 is connected to the driven base 4, the other end of the second fixing arm 42 extends permanently downward. The positions of the first fixing arms 32 correspond vertically and respectively to those of the second fixing arms 42. The length of each first fixing arm 32 is shorter than that of the corresponding second fixing arm 42.

Each first fixing arm 32 is provided with a first groove 33 that extends in the same direction as the first fixing arm. In this embodiment, each first groove 33 is upwardly concavely provided in the bottom side of the corresponding first fixing arm 32, and the two lateral sides of each first fixing arm 32 are each formed with a first slide slot 34. Each second fixing arm 42, on the other hand, is provided with a second groove 43 that extends in the same direction as the second fixing arm. In this embodiment, each second groove 43 penetrates the corresponding second fixing arm 42 vertically, and the two lateral sides of each second fixing arm 42 are each formed with a second slide slot 44.

Each pair of first and second fixing arms 32, 42 that correspond in position to each other are connected with a gripping arm 5. The bottom end of each gripping arm 5 is provided with a hook 51 to be hooked to a workpiece. Each gripping arm 5 extends through the second groove 43 of the corresponding second fixing arm 42 into the first groove 33 of the corresponding first fixing arm 32. The two lateral portions of each gripping arm 5 that face the first slide slots 34 of the corresponding first fixing arm 32 respectively are each provided with a first protruding block 52, and the two lateral portions of each gripping arm 5 that face the second slide slots 44 of the corresponding second fixing arm 42 respectively are each provided with a second protruding block 53. The first protruding blocks 52 and the second protruding blocks 53 of each gripping arm 5 are provided in the corresponding first slide slots 34 and the corresponding second slide slots 44 respectively in a slidable manner so that the positions at which each gripping arm 5 is connected respectively to the corresponding first fixing arm 32 and the corresponding second fixing arm 42 can be changed.

The puller structure described above is used in the following manner. To begin with, referring to FIG. 3, the wing nut 21 is operated to adapt the puller structure to the size of the workpiece 6A to be worked on. More specifically, the wing nut 21 is operated to move the connecting member 2, in order for the connecting member 2 to move the driven base 4 and thereby adjust the second fixing arms 42 to appropriate positions. Then, with the first protruding blocks 52 and the second protruding blocks 53 of each gripping arm 5 sliding freely in the corresponding first slide slots 34 and the corresponding second slide slots 44 respectively, the gripping arms 5 are opened as wide as the workpiece 6A and eventually fastened securely to the workpiece 6A so that the threaded rod 1 can be rotated to pull out the shaft in the workpiece 6A.

According to the above, the span of, and the gripping distance between, the gripping arms 5 can be adjusted by varying the positions at which each gripping arm 5 is connected respectively to the corresponding first fixing arm 32 and the corresponding second fixing arm 42, and this allows the puller structure to adapt to workpieces of different sizes. When the puller structure is used on a workpiece 6B (see FIG. 4) wider than the workpiece 6A in FIG. 3, the first protruding blocks 52 at the top end of each gripping arm 5 can be slid inward with respect to the corresponding first fixing arm 32 (i.e., the position at which each gripping arm 5 is connected to the corresponding first fixing arm 32 can be moved inward with respect to the corresponding first fixing arm 32), and the second protruding blocks 53 on the middle section of each gripping arm 5 can be slid outward with respect to the corresponding second fixing arm 42 (i.e., the position at which each gripping arm 5 is connected to the corresponding second fixing arm 42 can be moved outward with respect to the corresponding second fixing arm 42), in order to further increase the span of, and the gripping distance between, the gripping arms 5 and thereby adapt the puller structure to the workpiece 6B.

Another advantage of the present invention is that, while the disclosed puller structure is applicable to relatively large workpieces, the space occupied by the puller structure is smaller than its prior art counterparts because the first fixing arms 32 are shorter than the second fixing arms 42.

Figure 5:
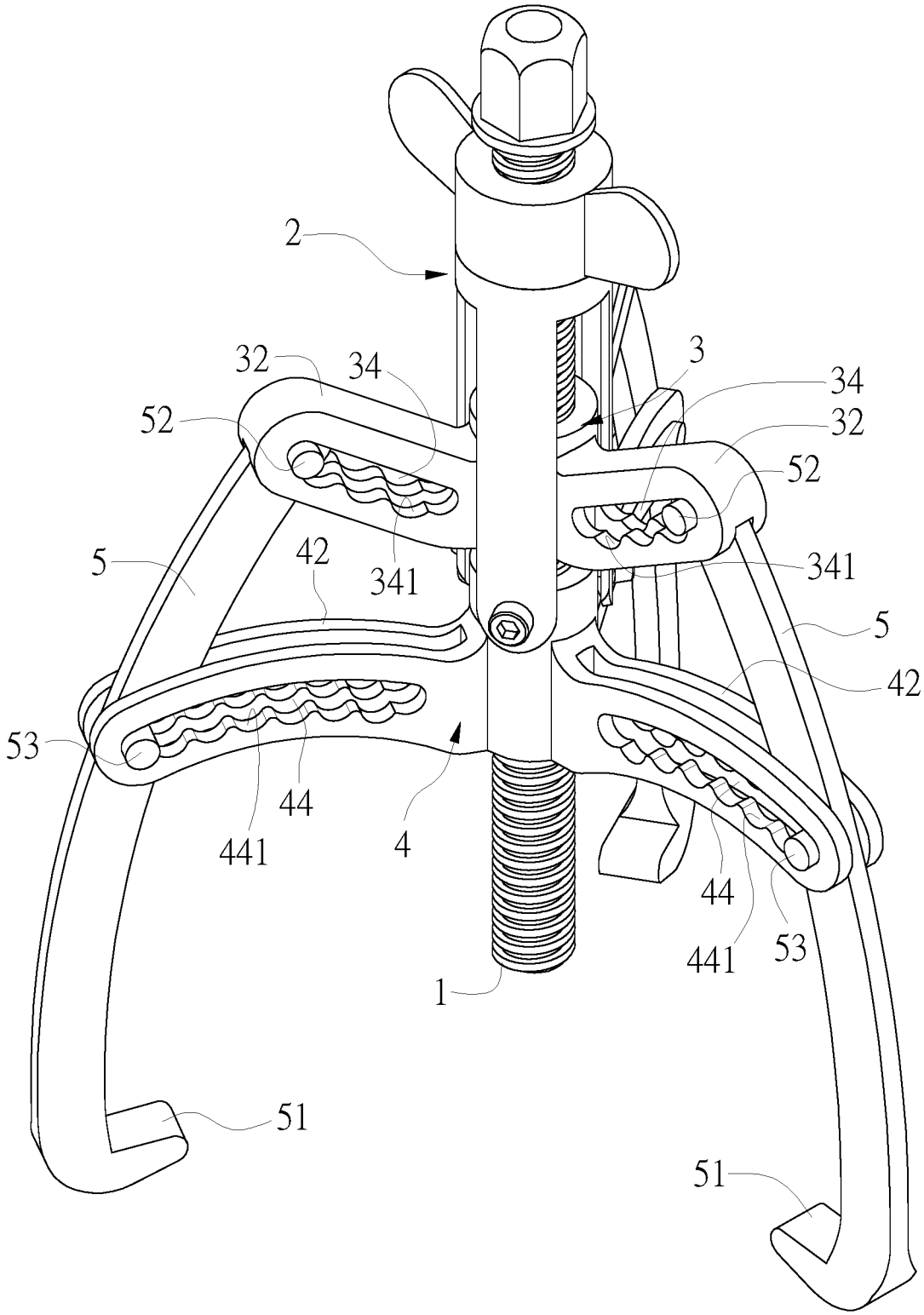
FIG. 5 is a perspective view of the puller structure according to the second embodiment of the present invention.
Figure 6:
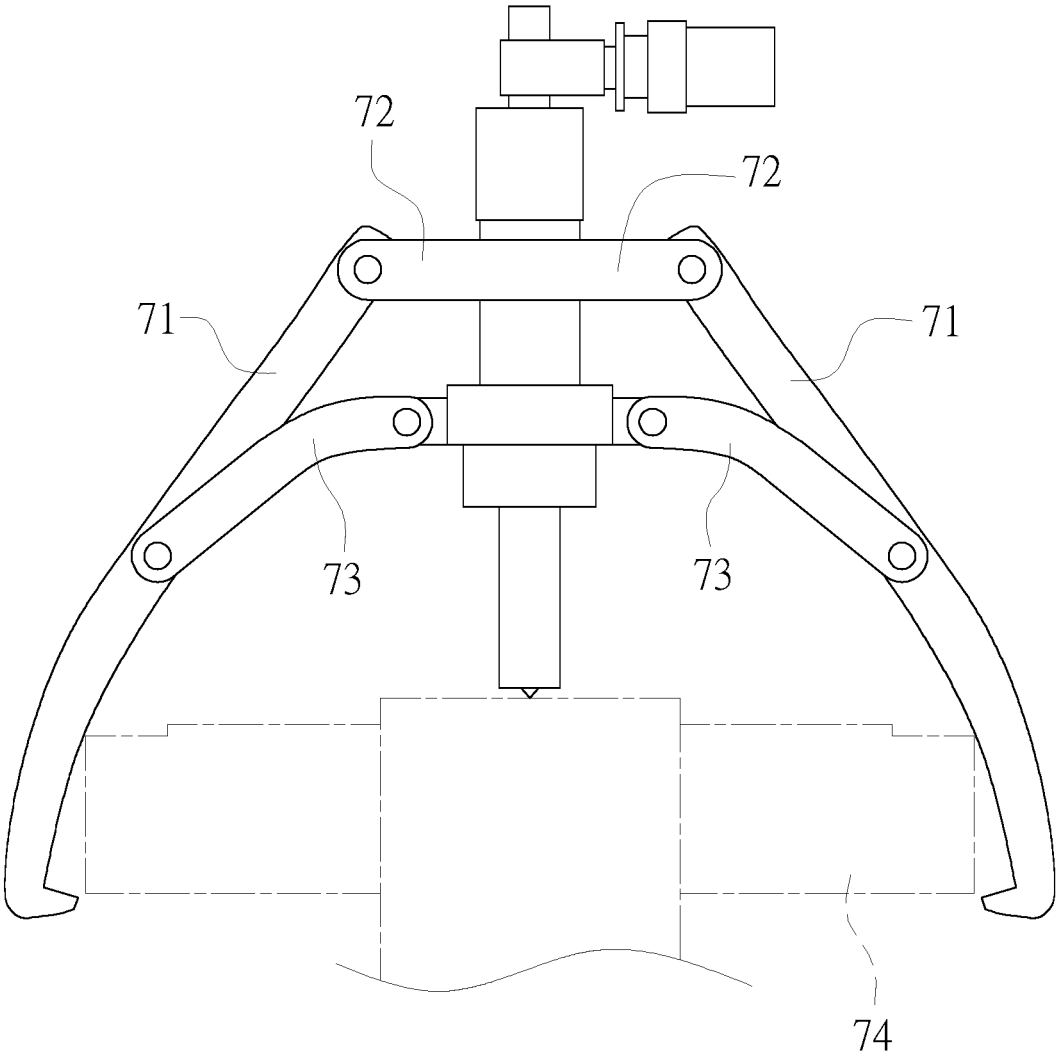
FIG. 6 PRIOR ART
FIG. 6 schematically shows a conventional puller structure.
Figure 7:
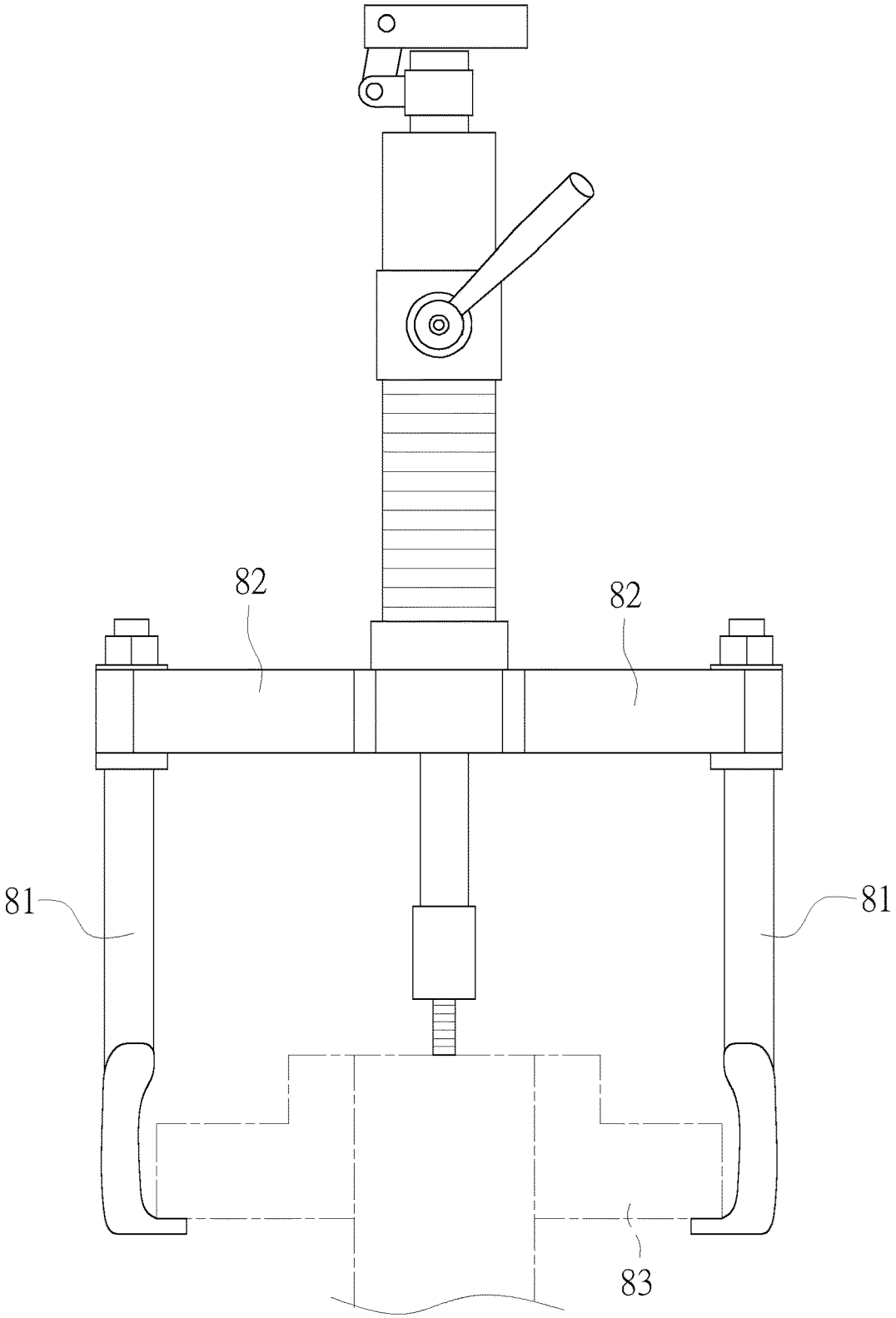
FIG. 7 PRIOR ART
FIG. 7 schematically shows another conventional puller structure.
Figure 8:
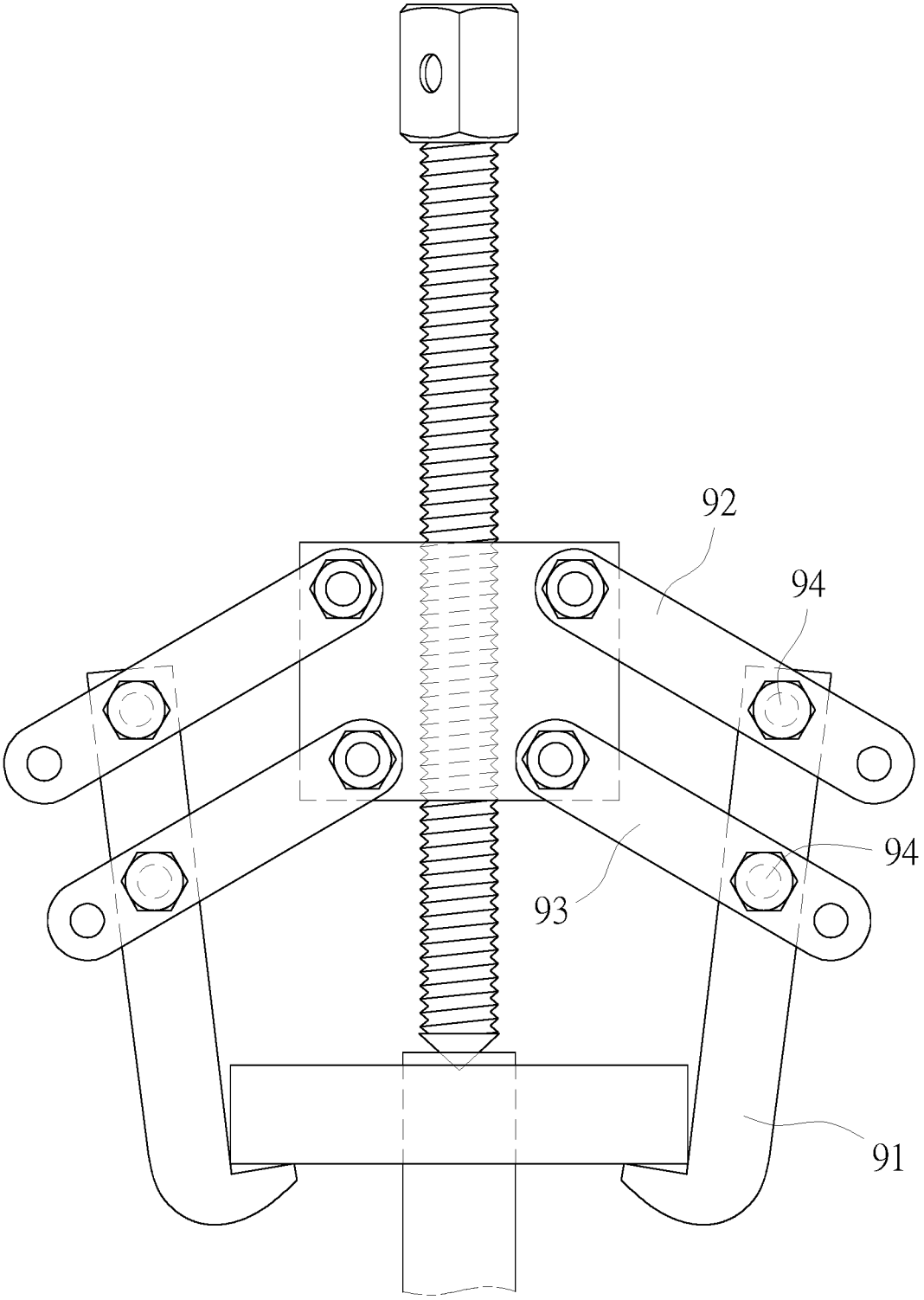
FIG. 8 PRIOR ART
FIG. 8 schematically shows another conventional puller structure.

FIG. 5 shows the second embodiment of the present invention. This embodiment is structurally based on the first embodiment and demonstrates a structural variation of the first slide slots 34 and of the second slide slots 44. In this embodiment, the bottom edge of each first slide slot 34 is provided with a plurality of first positioning recesses 341 that form a wavy shape, and the bottom edge of each second slide slot 44 is provided with a plurality of second positioning recesses 441 that also form a wavy shape. When the puller structure of this embodiment is used to pull out a shaft, the first protruding blocks 52 of each gripping arm 5 can be respectively engaged in particular ones of the first positioning recesses 341 of the corresponding first slide slots 34, and the second protruding blocks 53 of each gripping arm Scan be respectively engaged in particular ones of the second positioning recesses 441 of the corresponding second slide slots 44, thereby securing the gripping arms 5 in position.

Figure 3:
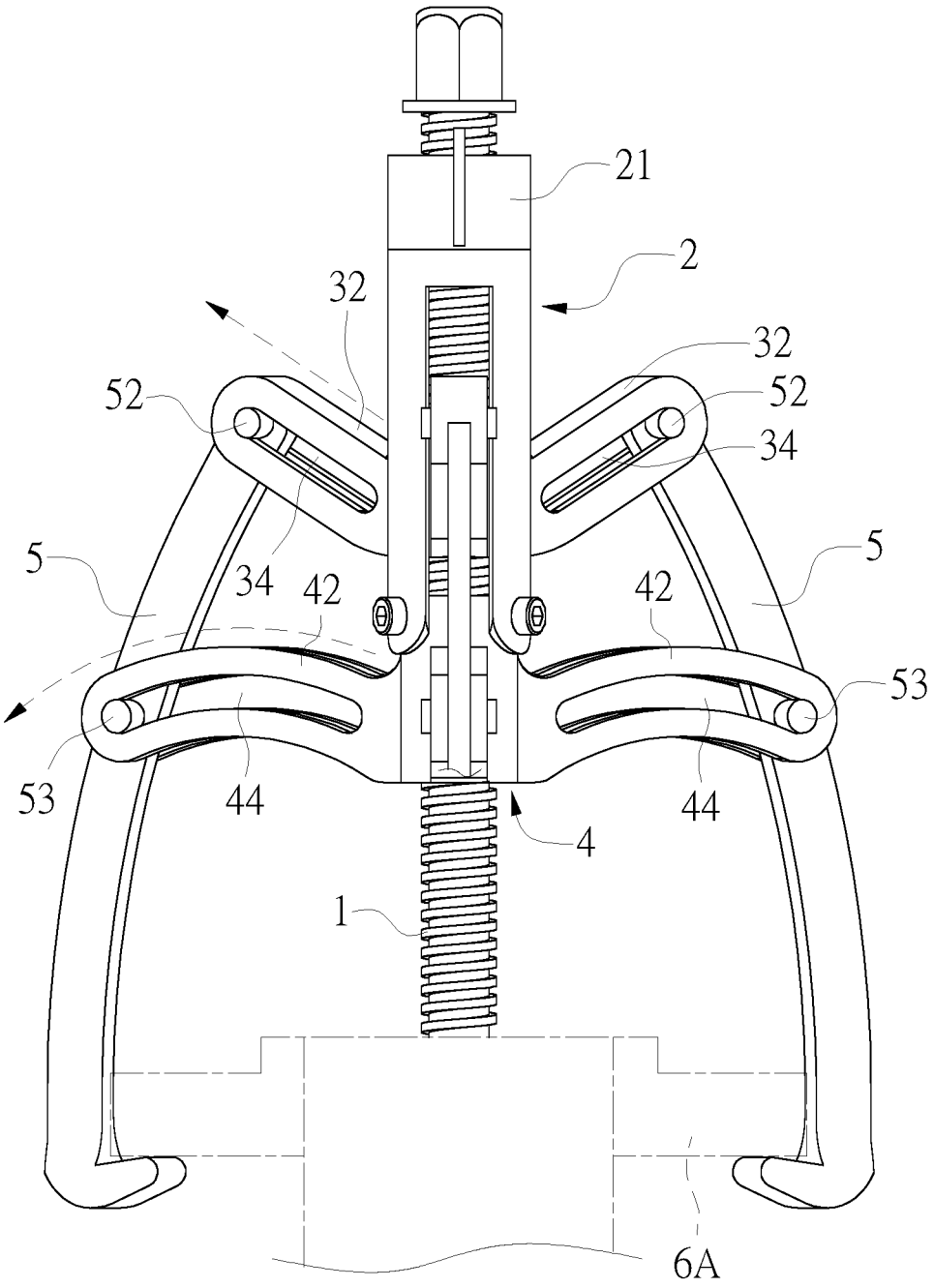
FIG. 3 and FIG. 4 show certain states of use of the puller structure in FIG. 1.
Figure 4:
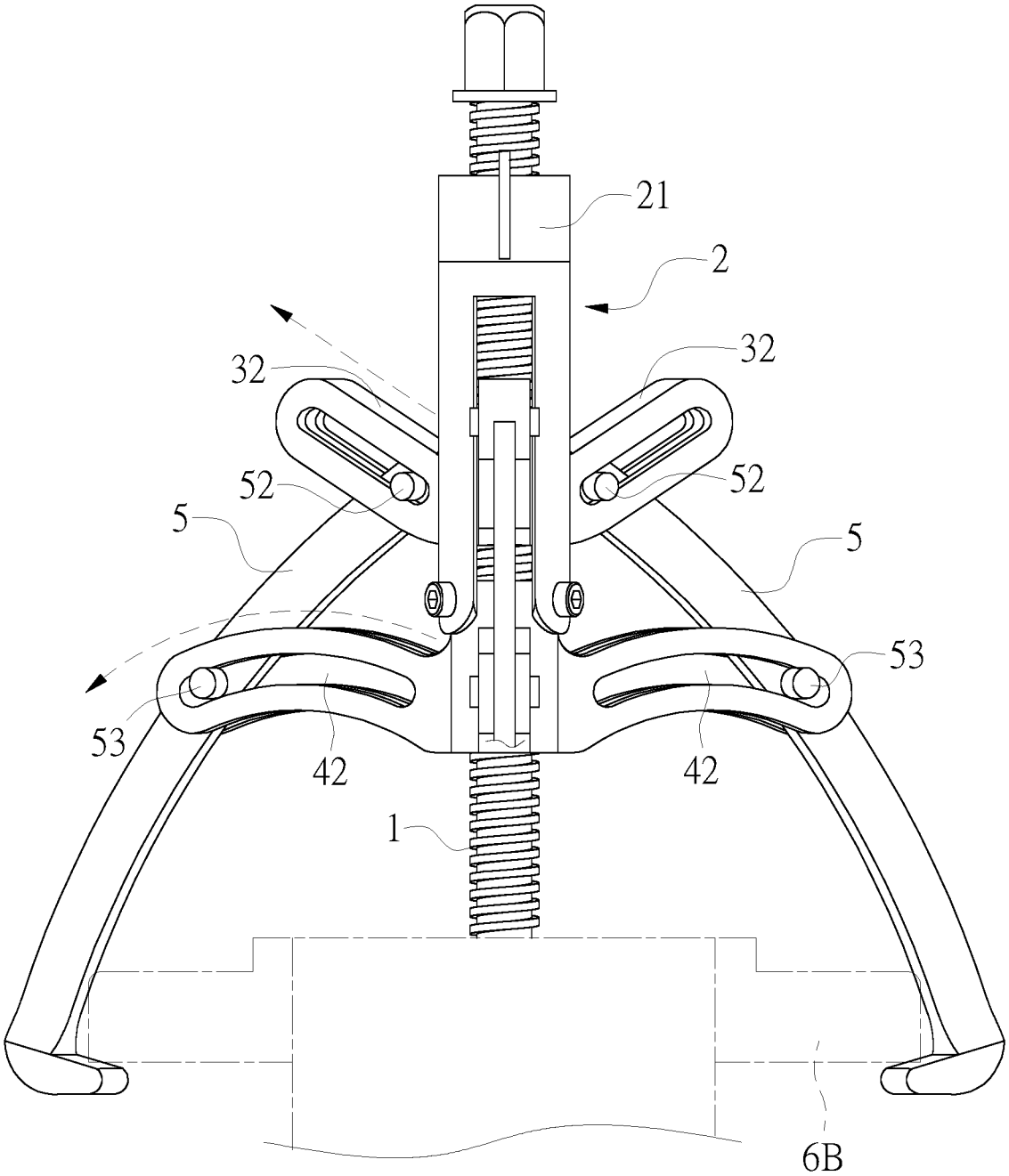

Besides, referring to FIG. 3 and FIG. 4, according to the first fixing arm 32 extends permanently and obliquely upward from the fixing base 3, and one end of the second fixing arm 42 extends permanently downward, therefore a distance between the first protruding blocks 52 and the second protruding blocks 53 can be enlarged than the conventional structure. Eventually, the force receive points on the gripping arms 5 are evenly distributed, and a gripping width of the two gripping arms 5 can be expanded.

What is claimed is:

1. A puller structure, comprising a threaded rod, a connecting member, a fixing base, and a driven base, wherein the fixing base is provided with a threaded hole, the driven base is provided with a through hole, the connecting member has a top end provided with a wing nut, the threaded rod extends downward through and is threadedly connected with the wing nut and the threaded hole of the fixing base and then extends through the through hole of the driven base, the connecting member is downwardly extended with a plurality of extension arms that are arranged at intervals, the extension arms are fixedly connected to the driven base, the fixing base is provided with a plurality of first fixing arms that extend outward, the driven base is provided with a plurality of second fixing arms that extend outward, the first fixing arms extend through gaps between the extension arms respectively, the first fixing arms correspond in position to the second fixing arms vertically and respectively, and each said first fixing arm and a corresponding said second fixing arm are connected with a gripping arm, the puller structure being characterized in that:

the first fixing arms extend permanently and obliquely upward from the fixing base, the second fixing arms extend permanently in a curved manner from the driven base, therefore one end of the second fixing arm is connected to the driven base, the other end of the second fixing arm extends permanently downward, each said first fixing arm has a shorter length than the corresponding second fixing arm, each said first fixing arm is provided with a first groove that extends in a same direction as the each said first fixing arm, each said second fixing arm is provided with a second groove that extends in a same direction as the each said second fixing arm, and each said gripping arm is slidably provided in a corresponding said first groove and a corresponding said second groove via a first protruding block and a second protruding block respectively;

the first groove of each said first fixing arm is upwardly concavely provided in a bottom side of each said first fixing arm, each said first fixing arm has two lateral sides each formed with a first slide slot, and two said first protruding blocks are provided respectively on two lateral portions of each said gripping arm that face the first slide slots of a corresponding said first fixing arm, and extend through the first slide slots of the corresponding first fixing arm respectively;

the second groove of each said second fixing arm penetrates the each said second fixing arm vertically, each said second fixing arm has two lateral sides each formed with a second slide slot, and two said second protruding blocks are provided respectively on two lateral portions of each said gripping arm that face the second slide slots of a corresponding said second fixing arm, and extend through the second slide slots of the corresponding second fixing arm respectively.

2. The puller structure of claim 1, wherein each said first slide slot has a bottom edge provided with a plurality of first positioning recesses that form a wavy shape.

3. The puller structure of claim 1, wherein each said second slide slot has a bottom edge provided with a plurality of second positioning recesses that form a wavy shape.

* * * * *